US008257513B2

(12) United States Patent
Nakaya et al.

(10) Patent No.: US 8,257,513 B2
(45) Date of Patent: Sep. 4, 2012

(54) HIGH STRENGTH STEEL SHEET EXCELLENT IN BENDING WORKABILITY AND FATIGUE STRENGTH

(75) Inventors: Michiharu Nakaya, Kakogawa (JP); Tetsuji Hoshika, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 167 days.

(21) Appl. No.: 12/671,453

(22) PCT Filed: May 28, 2008

(86) PCT No.: PCT/JP2008/059806

§ 371 (c)(1), (2), (4) Date: Jan. 29, 2010

(87) PCT Pub. No.: WO2009/016881

PCT Pub. Date: Feb. 5, 2009

(65) Prior Publication Data

US 2010/0183472 A1 Jul. 22, 2010

(30) Foreign Application Priority Data

Aug. 1, 2007 (JP) ..... 2007-201170

(51) Int. Cl.
*C22C 38/00* (2006.01)
*C22C 38/22* (2006.01)

(52) U.S. Cl. ..... 148/334; 148/320; 148/337; 148/661; 148/664; 420/110

(58) Field of Classification Search ..... 148/500–507, 148/559, 579, 601–603, 622–624, 648–654, 148/660–664, 320, 328, 330–337; 420/8, 420/83–85, 104–129
See application file for complete search history.

(56) References Cited

U.S. PATENT DOCUMENTS 6,280,538 B1 8/2001 Soshiroda et al.
(Continued)

FOREIGN PATENT DOCUMENTS

JP 60 100630 6/1985
(Continued)

OTHER PUBLICATIONS

U.S. Appl. No. 12/303,566, filed Dec. 5, 2008, Nakaya, et al.
(Continued)

*Primary Examiner* — Scott Kastler
*Assistant Examiner* — Vanessa Luk
(74) *Attorney, Agent, or Firm* — Oblon, Spivak, McClelland, Maier & Neustadt, L.L.P.

(57) ABSTRACT

The present invention provides a high strength steel sheet with 780 MPa class tensile strength excellent in bending workability and fatigue strength. The high strength steel sheet is (1) a steel sheet whose steel composition contains: C: 0.05-0.20%; Si: 0.6-2.0%; Mn: 1.6-3.0%; P: 0.05% or below; S: 0.01% or below; Al: 0.1% or below; and N: 0.01% or below, the balance comprising iron and inevitable impurities, in which (2) a microstructure comprises a polygonal ferrite structure and a structure formed by low-temperature transformation, in which, when a sheet plane located at a depth of 0.1 mm from a surface of the steel sheet is in the observation under a scanning electron microscope with respect to twenty sights in total in different positions in the sheet-width direction, the maximum value of the areal proportion of the polygonal ferrite (Fmax) and the minimum value of the areal proportion of the ferrite (Fmin) in a 50 μm×50 μm area in each sight satisfy Fmax≦80%, Fmin≧10%, and Fmax−Fmin≦40%.

12 Claims, 2 Drawing Sheets

U.S. PATENT DOCUMENTS

| | | | | |
|---|---|---|---|---|
| 2004/0226635 | A1* | 11/2004 | Ikeda et al. | 148/649 |
| 2005/0161134 | A1* | 7/2005 | Ikeda et al. | 148/651 |
| 2009/0065098 | A1 | 3/2009 | Soshiroda et al. | |

FOREIGN PATENT DOCUMENTS

| | | |
|---|---|---|
| JP | 5 331550 | 12/1993 |
| JP | 2001 335890 | 12/2001 |
| JP | 2002 363694 | 12/2002 |
| JP | 2004 68050 | 3/2004 |
| JP | 2004 149812 | 5/2004 |
| JP | 2005 154872 | 6/2005 |
| JP | 2005 171321 | 6/2005 |
| JP | 2006 70328 | 3/2006 |

OTHER PUBLICATIONS

U.S. Appl. No. 12/303,634, filed Dec. 5, 2008, Nakaya, et al.

* cited by examiner

WHITE: POLYGONAL FERRITE
GRAY: MARTENSITE

HIGH STRENGTH STEEL SHEET EXCELLENT IN BENDING WORKABILITY AND FATIGUE STRENGTH

TECHNICAL FIELD

The present invention relates to a high strength steel sheet excellent with 780 MPa or above tensile strength excellent in bending workability and fatigue strength. The high strength steel sheet of the present invention is suitably used, for example, in a structural member for an automobile (for example, a body structure member such as a pillar, member, reinforcement and the like; a strength member such as a bumper, door guard bar, seat component, chassis parts) and the like.

BACKGROUND ART

In recent years, the demand of a high strength steel sheet has been increasing more and more with the aim of such as lowering the fuel cost by reducing the vehicular body weight of an automobile and the like and securing safety in collision. In accordance with that, the demand on the tensile strength of the steel sheet also has been increasing, and a high strength steel sheet of 780 MPa class or above is required instead of a low strength steel sheet of 590 MPa class. However, when the tensile strength becomes 780 MPa class or above, deterioration of formability is inevitable, and in particular, deterioration of bending workability becomes a problem. Bending work is roughly divided, according to bending direction, to rolling direction bending [bending in which the bending axis is the direction perpendicular to the rolling direction (L direction)] and sheet-width direction bending [bending in which the bending axis is parallel (C direction) to the rolling direction (C direction)]. In a low strength steel sheet of 590 MPa class, both bending work can be performed comparatively easily, however, as the tensile strength becomes higher, bending work in C direction becomes difficult, and bending work in L direction which is said to be easy to perform bending work compared to that in C direction is liable to become difficult as well.

As a high strength steel sheet excellent in bending workability, a dual-phase steel sheet in which the ferrite phase and the low-temperature transformation phase such as martensite and bainite co-exist is used. The dual-phase steel sheet is one enabling improvement of both strength and workability simultaneously by dispersing the hard low-temperature transformation phase in soft ferritic matrix, and the methods described in the Patent Document 1 to Patent Document 5, for example, have been proposed.

The Patent Document 1 was proposed by the applicant of the present application and describes a method for improving bending workability by controlling the number of oxide-based inclusions present in a fracture. The Patent Document 2 describes a method for preventing a crack during bending work by formation of bainite including carbide and/or martensite-including carbide. The Patent Document 3 describes that elongation, stretch flange formability, and bending workability when bent in the rolling direction (L direction) are improved by optimization of the ferritic grain size and the fraction and hardness of a phase formed by low-temperature transformation. The Patent Document 4 describes a method for securing bending workability by lowering the hardness of a surface layer than that of the inner part and suppressing variation of Vickers hardness of the inner part in a high strength steel sheet mainly of bainite or martensite. The Patent Document 5 discloses a high tensile strength steel sheet excellent in bending workability in any direction of rolling direction bending, width direction bending, and 45 degree direction bending (bending with the bending axis direction inclined by 45 degrees against the rolling direction) realized by heating steel with a specific chemical composition and appropriately controlling the hot rolling condition (particularly hot finishing rolling temperature, cooling rate thereafter, and winding temperature) and the annealing condition (annealing temperature and cooling rate thereafter).

On the other hand, in order to make the above described high strength steel sheet thin to adapt automobile components and the like, it is necessary to be excellent in fatigue strength. The reason is that the stress during traveling of an automobile increases by thinning, therefore the risk of fatigue failure increases if the fatigue strength is low. However, the fatigue strength is not considered in the above Patent Documents.

[Patent document 1] Japanese Unexamined Patent Application Publication No. 2002-363694

[Patent document 2] Japanese Unexamined Patent Application Publication No. 2004-68050

[Patent document 3] Japanese Unexamined Patent Application Publication No. 2005-171321

[Patent document 4] Japanese Unexamined Patent Application Publication No. 2006-70328

[Patent document 5] Japanese Unexamined Patent Application Publication No. 2001-335890

DISCLOSURE OF THE INVENTION

Problem to be Solved by the Invention

The present invention was developed based on the above circumstances, and its object is to provide a high strength steel sheet with 780 MPa class tensile strength excellent in bending workability and fatigue strength.

Means for Solving the Problem

A high strength steel sheet of the present invention that could solve the above problem is:

(1) a steel sheet whose steel composition contains:

C: 0.05-0.20% (in mass % with respect to chemical composition, hereinafter the same);

Si: 0.6-2.0%;

Mn: 1.6-3.0%;

P: 0.05% or below;

S: 0.01% or below;

Al: 0.1% or below; and

N: 0.01% or below, the balance comprising iron and inevitable impurities; in which (2) a microstructure comprises a polygonal ferrite structure and a structure formed by low-temperature transformation, in which, when a plane located at a depth of 0.1 mm from a surface of the steel sheet is in the observation under a scanning electron microscope (SEM) with respect to twenty sights in total in different positions in the sheet-width direction, the maximum value of areal proportion of the polygonal ferrite (Fmax) and the minimum value of areal proportion of the polygonal ferrite (Fmin) in a 50 μm×50 μm area in each sight satisfy all of Fmax≦80%, Fmin≧10%, and Fmax−Fmin≦40%.

In a preferred embodiment, the steel composition further contains at least one kind selected from a group comprising:

Nb: 0.1% or below;

Ti: 0.2% or below;

Cr: 1.0% or below; and

Mo: 0.5% or below.

In a preferred embodiment, the base steel further contains:
Ca: 0.003% or below; and/or
REM: 0.003% or below.

Effects of the Invention

In accordance with the present invention, a high strength steel sheet with 780 MPa class excellent in bending workability in L direction and C direction as well as high in fatigue strength could be provided.

DESCRIPTION OF REFERENCE NUMERALS

1: Die
2: Test piece
3: Punch
4: Clearance
A: Direction of testing force

BEST MODE FOR CARRYING OUT THE INVENTION

In order to provide a high strength steel sheet with 780 MPa class tensile strength particularly used suitably for structural components of an automobile excellent in bending workability in L direction and C direction as well as in fatigue strength and preferably excellent in elongation and stretch flangeability, the inventors of the present invention has made a lot of investigations. As a result, followings have been found out and the present invention has been completed.

(a) In a dual-phase steel sheet comprising a polygonal ferrite and a phase formed by low-temperature transformation, particularly, when the maximum value and the minimum value as well as the difference of the maximum value and the minimum value (variation) of areal proportion of the polygonal ferrite observed in a predetermined area of a sheet plane are appropriately controlled, the desired object is accomplished.

(b) In order to manufacture such high strength steel sheet, it is effective, in particular, to conduct the annealing process after hot rolling by a predetermined two-step cooling method (rapid cooling →slow cooling) with different cooling rate.

That is, the characteristic portion of the steel sheet of the present invention is that the areal proportion of the microstructure in a sheet plane is finely stipulated. Conventionally, as are exemplarily represented by the above Patent Documents, characteristics such as the bending workability were improved by stipulating the areal proportion and the like of the microstructure present in the cross-section in the sheet thickness direction, and the microstructure present in the sheet plane was not watched at all, which was different from the present invention. However, according to the result of the investigations of the inventors of the present invention, it was found out that the microstructure present in the sheet plane largely varied in the sheet-width direction and the areal proportion of the microstructure largely affected on improvement of bending workability and fatigue strength, therefore the above requisites were specified.

This point will be described in a little more detail.

In order to clarify the mechanism of generation of a crack (fracture) in bending work and a fatigue crack in a 780 MPa class or above dual-phase steel sheet comprising a polygonal ferrite and a phase formed by low-temperature transformation, the inventors of the present invention first examined the microstructure in detail watching the vicinity of a surface layer of the sheet plane (the sheet plane generated by polishing by approximately 0.1 mm in the depth direction from the uppermost layer surface of the steel sheet; the face perpendicular to the sheet thickness direction).

Figure 1:
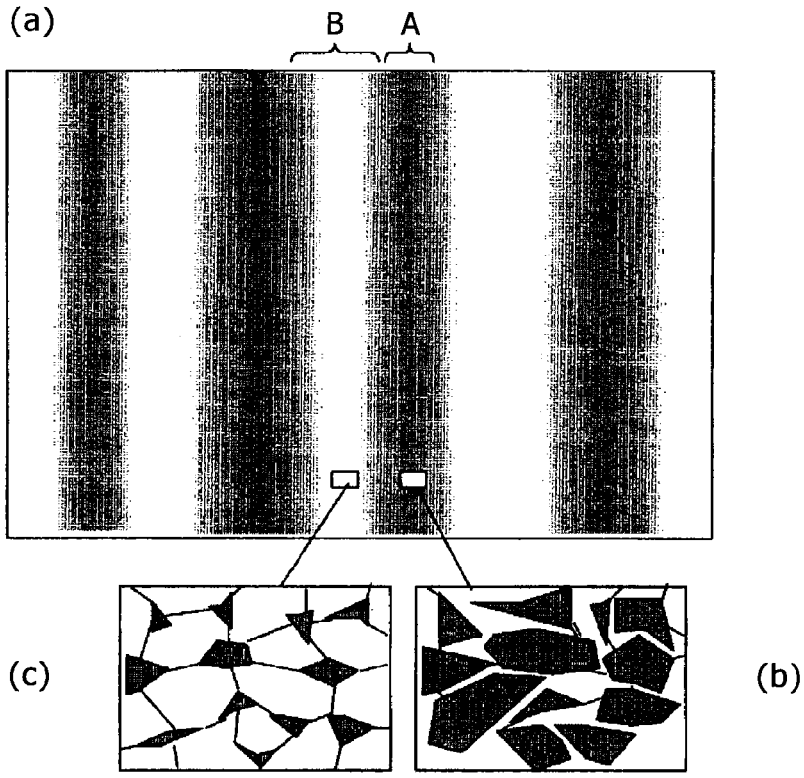
FIG. 1 schematically shows the diversifying condition of the microstructure in a sheet plane a dual-phase steel sheet.

FIG. 1 is a schematic drawing showing the diversifying condition of the microstructure in the vicinity of the surface layer of the sheet plane. In the schematic drawing, polygonal ferrite is shown in white color, and the phase formed by low-temperature transformation such as martensite is shown in black color (gray). The size of the polygonal ferrite and the phase formed by low-temperature transformation is approximately 10 μm or below.

From FIG. 1 (*a*), it is known that the area A looking generally grayish and the area B looking generally whitish line up alternately in the sheet-width direction with approximately some 10 s μm-some 100 s μm interval in the sheet plane. In this regard, FIG. 1 (*b*) is the enlarged view of the area A, where the phase formed by low-temperature transformation such as martensite is spotted much, and the polygonal ferrite is less. On the other hand, FIG. 1 (*c*) is the enlarged view of the area B, where the polygonal ferrite is spotted much, and the phase formed by low-temperature transformation such as martensite is less. Thus, in the vicinity of the surface layer of the sheet plane, areas with different areal proportion of the polygonal ferrite and the phase formed by low-temperature transformation are present.

When bending work is performed on a dual-phase steel sheet having such a sheet plane microstructure, the strain concentrates in a portion in the vicinity of the surface layer where the polygonal ferrite is much present, and deformation of the area mainly with the phase formed by low-temperature transformation becomes very small. As a result, the strain difference in the vicinity of the boundary of the polygonal ferrite and the phase formed by low-temperature transformation and inside the polygonal ferrite is enlarged, and a crack becomes liable to occur. Also, the fatigue failure by repeated load occurs in the area where the polygonal ferrite is present much, therefore the spread of the initial crack can be inhibited by the hard phase formed by low-temperature transformation that co-exists. However, when the hard phase is less, such actions become insufficient and fatigue strength is affected adversely.

From the results described above, it was known that, whether the areal proportion of the polygonal ferrite and the phase formed by low-temperature transformation in the surface layer part of the sheet plane was less or much, a crack during bending formation occurred and fatigue strength also deteriorated. Further, it was known as well that the difference of the areal proportion of the polygonal ferrite and the phase formed by low-temperature transformation was preferably as little as possible, thus the strain occurring in the vicinity of the boundary of the polygonal ferrite and the phase formed by low-temperature transformation could be inhibited. Based on these results, the inventors of the present invention specified the above requisites.

In this specification, evaluation of "bending workability" is conducted by setting an acceptance criteria of "Rmin/t" according to the strength class of the steel sheet using the value obtained by dividing the minimum bending radius (Rmin) obtained by performing 90 degree bending work in L direction (rolling direction=longitudinal direction of the test piece) and C direction (the direction perpendicular to the rolling direction) by sheet thickness (t) of the steel sheet (Rmin/t) as a measure. The details are as described in the column of the examples described later. The reason is that bending workability varies according to the sheet thickness and the strength class of the steel sheet.

In this specification, "excellent in fatigue strength" means the case in which the fatigue limit ratio (ratio of fatigue strength/tensile strength) is approximately 0.45 or above when the plane bending fatigue test is conducted as per the method described in the column of the examples described later.

In the present specification, "sheet plane" does not mean the surface (uppermost surface) of a steel sheet but a sheet plane located at a depth of approximately 0.1 mm from the surface (the face perpendicular to the sheet thickness direction). The reason is that the areal proportion of the microstructure of the sheet plane in the uppermost layer part is changeable, whereas the areal proportion of the microstructure present in the sheet plane located at the position of the depth of approximately 0.1 mm from the uppermost surface hardly changes. Also, "depth of 0.1 mm" is not a strict stipulation, and in such a case of a thin steel sheet with the thickness of approximately 0.8-2.3 mm as the present invention, the sheet plane located in a position of approximately 1/20-1/8 against the sheet thickness is also allowable. That is because the areal proportion of the microstructure of the sheet plane hardly changes within the range.

Next, the high strength steel sheet of the present invention will be described in detail.

The high strength steel sheet of the present invention is a dual-phase steel sheet containing a predetermined steel composition and comprising a polygonal ferrite structure and a structure formed by low-temperature transformation, and in particular, is characterized that, when a sheet plane located at a depth of 0.1 mm from a surface of the steel sheet (hereinafter may possibly be referred to simply as a "sheet plane") is in the observation under a scanning electron microscope (SEM) of a 1,000-2,000 magnification with respect to twenty sights in total (one sight: approximately 60 μm×approximately 80 μm) in different positions in the sheet-width direction, the maximum value of the areal proportion of the polygonal ferrite (Fmax) and the minimum value of the areal proportion of the polygonal ferrite (Fmin) in a 50 μm×50 μm area in each sight satisfy all of (1) Fmax≦80%, (2) Fmin≧10%, and (3) Fmax−Fmin≦40%.

(1) The Minimum Value of the Areal Proportion of the Polygonal Ferrite Fmin≧10%

The minimum value of the areal proportion of the polygonal ferrite (Fmin) is an important requisite for securing good bending workability and obtaining excellent elongation characteristics, and as is exhibited in the examples described later, when Fmin is below 10%, bending workability deteriorates and elongation also deteriorates. Fmin is preferably 15% or above, more preferably 20% or above.

(2) The Maximum Value of the Areal Proportion of the Polygonal Ferrite Fmax≦80%

The maximum value of the areal proportion of the polygonal ferrite (Fmax) is an important parameter for securing the high strength of 780 MPa or above tensile strength and securing the hard phase inhibiting the spread of the fatigue crack of the surface layer by a designated quantity thereby securing excellent fatigue strength. As is exhibited in the examples described later, when Fmax exceeds 80%, the tensile strength and fatigue strength lowers. Fmax is preferably 75% or below, more preferably 70% or below.

(3) The Difference of the Maximum Value (Fmax) and the Minimum Value (Fmin) of the Areal Proportion of the Polygonal Ferrite≦40%

The difference of the maximum value (Fmax) and the minimum value (Fmin) of the areal proportion of the polygonal ferrite (variation) is an important parameter for securing desired bending workability, and, when the variation exceeds 40%, deformation concentrates in an area where the areal proportion of the polygonal ferrite is large in bending work, and bending workability (bending workability in C direction, in particular) deteriorates (refer to the examples described later). The variation is preferably as little as possible, for example, 30% or bellow is preferable, and 0% is most preferable.

The measurement method for the maximum value and the minimum value of the above described areal proportion of the polygonal ferrite is as follows.

First, a steel sheet for measuring the microstructure (the approximate size is 20 mm length×20 mm width×1.6 mm thickness) is prepared and is polished from the surface of the steel sheet to the depth of approximately 0.1 mm in the sheet thickness direction. Then, the polygonal ferrite present in the sheet plane (sheet-width direction) of the location is in the observation under a scanning electron microscope (SEM) of a 1,000-2,000 magnification. More specifically, the microstructure of twenty sights in total (one sight: approximately 60 μm×approximately 80 μm) with 0.1 μm pitch in the sheet-width direction is observed with the SEM, and is photographed with a 1,000-2,000 magnification. An area of 50 μm×50 μm is designated in the photo, image analysis is performed using an image analyzer "LUZEX F" made by NIRECO CORPORATION, and the areal proportion of the polygonal ferrite is obtained. The image analysis was performed by binarizing the polygonal ferrite phase and the phase other than the polygonal ferrite phase. The image analysis was performed with respect to the sights of twenty locations in total in the same manner, the areal proportion of the polygonal ferrite was measured, the minimum value of them was made Fmin, and the maximum value was made Fmax.

As described previously, the microstructure of the steel sheet of the present invention comprises soft polygonal ferrite and hard phase formed by low-temperature transformation. The polygonal ferrite is a structure useful for securing elongation and can enhance both strength and elongation by coexistence with the phase formed by low-temperature transformation. On the other hand, the phase formed by low-temperature transformation is a structure useful for securing strength, specifically, martensite (tempered martensite), bainite, and retained austenite can be cited. Because the mechanical characteristics can vary according to the kind of the phase formed by low-temperature transformation, the structure of the phase formed by low-temperature transformation can be appropriately controlled according to the desired characteristics. For example, in order to obtain a high strength steel sheet more excellent in elongation, it is preferable to raise the proportion of martensite and retained austenite, whereas in order to obtain a high strength steel sheet more excellent in stretch flange formability, it is preferable to raise the proportion of bainite, tempered martensite and the like.

The steel sheet of the present invention is characterized in stipulating in detail the areal proportion of the polygonal ferrite (the maximum value, the minimum value, and the difference of the maximum value and the minimum value) in the sheet face, and the ratio of the polygonal ferrite and the phase formed by low-temperature transformation included in the steel sheet (sheet thickness cross-section) is not particularly limited as far as the above requisites are satisfied.

The structure most characterizing the present invention was described above.

Next, the composition of steel of the present invention will be described.

C: 0.05-0.20%

Because C is an element necessary for securing the phase formed by low-temperature transformation by a designated quantity and obtaining high strength of 780 MPa or above, C quantity is made 0.05% or above. However, when it is added excessively, generation of the polygonal ferrite becomes insufficient, the minimum value of the areal proportion of the polygonal ferrite lowers, bending workability and ductility deteriorate (refer to the examples described later) and spot welding performance deteriorates, therefore the upper limit of C quantity is made 0.20%. Preferable C quantity is 0.07% or above and 0.17% or below.

Si: 0.6-2.0%

Si is an element necessary for securing high strength of 780 MPa or above, inhibiting generation of a fatigue crack by solid solution strengthening of the polygonal ferrite, and contributing to improvement of fatigue strength. Also it is an element useful for securing the minimum value of the areal proportion of the polygonal ferrite by promoting generation of the polygonal ferrite, and obtaining excellent bending workability (refer to the examples described later). In addition, Si is also effective in improving elongation and stretch flange formability. In order to exert these actions effectively, the lower limit of Si quantity is made 0.6%. However, even if it is added excessively, the above actions saturate which is an economical loss and the problems such as causing hot-brittleness occurs, therefore the upper limit of Si Quantity is made 2.0%. Si quantity is preferably 0.8% or above and 1.8% or below.

Mn: 1.6-3.0%

Mn is an element necessary for securing the predetermined phase formed by low-temperature transformation by inhibiting excessive generation of the polygonal ferrite, and securing high strength of 780 MPa or above. Also, similar to Si, Mn is an element inhibiting generation of a fatigue crack by solid solution strengthening of the polygonal ferrite, and contributing to improvement of fatigue strength as well. In order to exert these actions effectively, the lower limit of Mn quantity is made 1.6%. However, if it is added excessively, it becomes difficult to secure the predetermined polygonal ferrite quantity, workability deteriorates, and spot welding performance and resistance to delayed fracture also deteriorate, therefore the upper limit of Mn quantity is made 3.0%. Preferable Mn quantity is 1.8% or above and 2.8% or below.

P: 0.05% or Below

Because P is an element deteriorating workability and spot welding performance, the upper limit is made 0.05%. P quantity is preferably as little as possible.

S: 0.01% or Below

Because S is an element lowering stretch flange formability and bending formability, the upper limit is made 0.01%. S quantity is preferably as little as possible.

Al: 0.1% or Below

Although Al is added with the aim of deoxidation, if it is added excessively, inclusions increase and stretch flange formability and bending workability deteriorate, therefore the upper limit is made 0.1%. Preferable Al quantity is 0.005% or above and 0.07% or below.

N: 0.01% or Below

When N is present excessively, deterioration of ductility may possibly be caused, therefore the upper limit is made 0.01%. N quantity is preferably as little as possible, and 0.006% or below is preferable. In general, the lower limit of N quantity is approximately 0.001% if the balance against the cost is considered on an actual operation level.

The steel composition of the present invention contains the above described elements and the balance: iron and inevitable impurities. However, the elements described below may be positively added with the aim of imparting other characteristics in such a range that the actions of the present invention are not impaired.

At least one kind selected from a group comprising Nb: 0.1% or below, Ti: 0.2% or below, Cr: 1.0% or below, and Mo: 0.5% or below Although these elements are the elements effective in improving strength, when they are excessive, it becomes difficult to secure the polygonal ferrite of a designated quantity and resistance to delayed fracture and spot welding performance deteriorate, therefore the upper limit is preferably made Nb: 0.1%, Ti: 0.2%, Cr: 1.0%, Mo: 0.5% respectively, more preferably Nb: 0.005% or above and 0.08% or below, Ti: 0.005% or above and 0.16% or below, Cr: 0.05% or above and 0.8% or below, Mo: 0.01% or above and 0.4% or below. These elements can be added solely, and two kinds or more can be used jointly also.

Ca: 0.003% or Below and/or REM: 0.003% or Below

Although these elements are the elements contributing to improving stretch flange formability, even if they are added excessively, the effect saturates only and which is an economical loss, therefore the upper limit is preferably Ca: 0.003%, REM: 0.003% respectively, more preferably Ca: 0.0005% or above and 0.0025% or below, REM: 0.0005% or above and 0.0025% or below. These elements can be added solely, and two kinds or more can be used jointly also.

In the present specification, REM means lanthanoid elements (15 elements in total from La to Lu in the periodic table). Among them, La and/or Ce are to be preferably contained. Also, the form of the REM added to molten steel is not particularly limited, for example, pure La, pure Ce and the like, or Fe—Si—La alloy, Fe—Si—Ce alloy, Fe—Si—La—Ce alloy and the like can be added as the REM. Further, misch metal can be added to molten steel. Misch metal is a mixture of the rare earth elements of the cerium group, more specifically, Ce is contained by approximately 40-50% and La is contained by approximately 20-40%. In the examples described later, misch metal is added.

In addition to the above described elements, for example, Cu, B, V, Mg may be added with the aim of improving resistance to delayed fracture. The upper limit of these elements, in general, is preferably made Cu: 1.0%, Ni: 1.0%, B: 0.003%, V: 0.3%, Mg: 0.001%, thereby the above actions can be improved without impairing the actions of the present invention. Further, with the aim of improving corrosion resistance and resistance to delayed fracture, Sn, Zn, Zr, W, As, Pb, Bi may be added. The total quantity of these elements, in general, is preferably 0.01% or below, thereby the above actions can be improved without impairing the actions of the present invention.

Next, the manufacturing method for the steel sheet of the present invention will be described.

Figure 2:
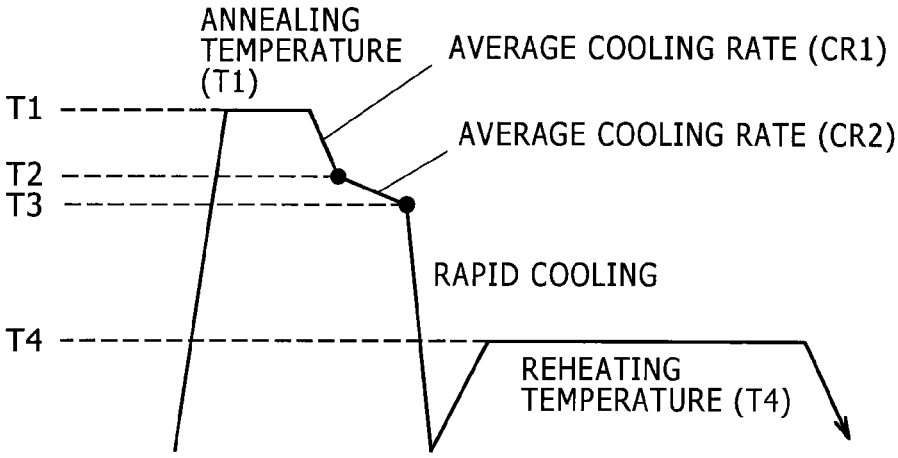
FIG. 2 is a schematic drawing showing a heat treatment pattern of the annealing process.

In order to obtain the steel sheet of the present invention in which the areal proportion of the polygonal ferrite present in the sheet plane (Fmax, Fmin, variation) satisfies all of the above requisites, in particular, the cooling condition in the annealing process after hot rolling (continuous annealing process) should be strictly controlled, and in the present invention, the two-step cooling pattern of rapid cooling (CR1 in the drawing)→slow cooling (CR2 in the drawing) as shown in FIG. 2 is adopted. With respect to those not performing the two-step cooling, the microstructure of the sheet plane does not satisfy the requisites of the present invention, therefore at least one of bending workability and fatigue strength deteriorates (refer to the examples described later).

Also, even if the above mentioned Patent Documents are referred to, the two-step cooling method like the present invention is not disclosed. For example, in an embodiment of the Patent Document 2, an annealing process by a cooling method of slow cooling→rapid cooling is disclosed as "retaining for 5 s or more in the 720-900° C. temperature range→cooling at 4-7° C./s average cooling rate (first step cooling rate) to 550-760° C.→cooling at 60-90° C./s average cooling rate (second step cooling rate) to 200-420° C.", however even if a cooling pattern imitating the method was actually performed, the steel sheet of the present invention could not be obtained, and in particular, bending workability in C direction deteriorated (refer to the examples described later). Also, in an embodiment of the Patent Document 3, cooling at 60° C./s average cooling rate in the temperature to 650-450° C. and cooling thereafter to a cooling stopping temperature range of 200-450° C. are described, however the average cooling rate to the cooling stopping temperature range is not described specifically.

The manufacturing method for the steel sheet of the present invention is characterized in appropriately controlling the cooling condition of the annealing process as described above, and the processes other than the above can adopt general methods for manufacturing the dual-phase steel sheet of the object of the present invention. The high strength steel sheet of the present invention is manufactured by, for example, continuous casting→hot rolling→pickling→cold rolling→continuous annealing, however the condition for each process other than the continuous annealing process is not particularly limited, and the conditions other than the cooling condition in the continuous annealing process (temperature-rise rate, annealing temperature and the like) are not particularly limited as well. Also, the steel sheet of the present invention includes a galvanized steel sheet of a hot dip galvanized steel sheet and a galvannealed steel sheet in addition to a cold rolled steel sheet, however the galvanizing condition is not particularly limited also, and appropriate temperature control can be performed including the continuous hot galvanizing line.

Below, a preferable manufacturing condition of the present invention will be described in detail referring to the heat treatment pattern of the continuous annealing shown in FIG. 2.

First, molten steel satisfying the composition of the present invention is smelted by a publicly known smelting method such as a converter and an electric furnace, and is made a steel strip such as a slab by continuous casting and casting-slabbing mill.

Next, the steel strip is hot rolled. More specifically, hot rolling may be performed directly after continuous casting, or, in manufacturing by continuous casting and casting-slabbing mill, hot rolling may be performed after cooling once to an appropriate temperature and heating by a heating furnace thereafter.

In the hot rolling process, it is preferable to perform heating to a temperature of approximately 1,200° C. or above, thereafter finishing the hot rolling at a temperature equal or higher than approximately $Ac_3$ point, and winding at 650° C. or below (preferably 600° C. or below). By performing hot rolling as described above, particularly, variation of the areal proportion of the polygonal ferrite of the sheet plane can be inhibited.

Then, according to the ordinary procedure, cold rolling and pickling are performed, and continuous annealing is thereafter performed.

In the annealing process, it is preferable to make the annealing temperature (soaking temperature, T1 in the drawing) $Ac_3$ point or above, and to firstly keep (anneal) the temperature for approximately 5 s or more. If T1 is below $Ac_3$ point or the annealing time becomes less than 5 s, particularly, variation of the areal proportion of the polygonal ferrite of the sheet plane is enlarged. Preferable annealing condition is T1: $Ac_3$ point +20° C. or more, annealing time: 10 s or more. Further, the upper limit of them is not particularly limited, however when the load of facilities is taken into consideration, it is preferable to make T1≦950° C., annealing time≦5 minutes.

In the present specification, $Ac_3$ point is calculated based on an equation described below.

$$Ac_3 \text{ point } (^\circ \text{C.})$$

$$=910-203\sqrt{[C]}-15.2[Ni]+44.7[Si]$$

$$+104[V]+31.5[Mo]-30[Mn]-11[Cr]$$

$$-20[Cu]+700[P]+400[Al]+400[Ti]$$

[In the equation, [ ] means the content (%) of each element].

After annealing, cooling is performed. In the present invention, it is of vital importance to perform the two-step cooling of rapid cooling (CR1)→slow cooling (CR2) with T2 temperature as a boundary with respect to the temperature range (T1-T3) of approximately 460° C. or above and approximately 700° C. or below (T3 in the drawing) after annealing (T1 in the drawing) as shown in FIG. 2. More specifically, rapid cooling is performed in the temperature range of annealing (T3-T2) at the average cooling rate (CR1) of approximately 15° C./s or more, thereafter slow cooling is performed in the temperature range of T2-T3 at the average cooling rate (CR2) of approximately 10° C./s or below. Thus, by performing rapid cooling at a cooling rate enabling inhibiting polygonal ferrite transformation in the temperature range after annealing to T2, thereafter performing slow cooling for approximately 2-30 s in the temperature range of T2 to T3 (the temperature range in the vicinity of the ferrite nose), thereby the areal proportion of the polygonal ferrite of the sheet plane can be all controlled appropriately, and the uniform microstructure can be obtained. T2 can be appropriately set according to the composition of steel within the temperature range between T1 and T3. Generally, T2 is preferably made the range of 500-700° C., more preferably the range of 550-650° C.

As shown in the example described later, when CR1 is low, the maximum value (Fmax) of the areal proportion of the polygonal ferrite is enlarged and fatigue strength lowers, whereas when CR2 is high, variation of the areal proportion of the polygonal ferrite is enlarged and bending workability (particularly, bending workability in C direction) deteriorates.

In order to obtain a high strength steel sheet excellent in bending workability and fatigue strength, CR1 is preferable to be as high as possible, for example, approximately 15° C./s or above is preferable, and approximately 20° C./s or above is more preferable. On the other hand, CR2 is preferable to be as low as possible, for example, approximately 15° C./s or below is preferable, and approximately 10° C./s or below is more preferable. The upper limit of CR1 is not particularly limited, however if the cooling capacity and the like of the facilities of the actual operation level is taken into consideration, approximately 100° C./s is preferable. Also the lower limit of CR2 also is not particularly limited also, however if the fact that a heat insulation device and the like becomes necessary when CR2 becomes extraordinarily low is taken into consideration, approximately 1° C./s is preferable.

Further, in the present invention, the temperature T3 is also important, and as shown in the examples described later, when T3 becomes excessively low, the maximum value (Fmax) of the areal proportion of the polygonal ferrite increases and fatigue strength lowers. Preferable T3 varies according to the composition, which is approximately 480-680° C.

After cooling is performed as described above, if rapid cooling is performed at the average cooling rate of approximately 100° C./s or above by performing, for example, water quenching and the like in the temperature range of T3 to 200° C. or below, a designated phase formed by low-temperature transformation can be obtained. When stretch flange formability is to be enhanced or the like thereafter, according to necessity, reheating to a temperature of approximately 500° C. or below (T4 in the drawing) and cooling thereafter to the room temperature may be performed.

EXAMPLES

Although the present invention will be described below more specifically referring to experiments, the present invention is not limited by the experiments described below, and can be implemented with modifications added appropriately within the scope adaptable to the purposes described previously and later, and any of them is to be included within the technical range of the present invention.

(Manufacturing Method of Steel Sheet)

Steel of a various componential composition shown in Table 1 (balance: Fe and inevitable impurities) was molten, was subjected to continuous casting, and was thereafter hot-rolled under the following condition (2.6 mm finishing thickness) followed by pickling and cold rolling to the sheet thickness of 1.4 mm.

Heating temperature: 30 minutes at 1,250° C.

Finishing temperature: 880° C.

Winding temperature: 550° C.

Next, after annealing was performed under the heat treatment condition shown in Table 2, reheating was performed, and the cold rolled steel sheet was obtained. More specifically, after heated to a predetermined temperature (T1 in FIG. 2) and maintained for 180 s, gas cooling was performed by various cooling patterns shown in Table 2 followed by water quenching.

(Observation of Microstructure)

The microstructure of the steel sheet thus obtained was observed by the above described method, the maximum value (Fmax) and the minimum value (Fmin) of the areal proportion of the polygonal ferrite were measured, and the difference of the maximum value and the minimum value (variation) was calculated.

(Evaluation of Characteristics)

Tensile strength, bending workability, and fatigue strength of the steel sheet were measured as follows.

A JIS No. 5 tensile test piece was obtained from the direction perpendicular to the rolling direction of the steel sheet, and tensile strength (TS) was measured according to JIS Z 2241. In the present example, those with 780 MPa or above tensile strength were made o (passed). For reference purpose, elongation (EL) and yield stress (YP) were also measured.

90 degree bending work in L direction (rolling direction=longitudinal direction of the test piece) and C direction (the direction perpendicular to the rolling direction) was performed as described below, the minimum bending radius (Rmin) was calculated, and the bending workability was evaluated with the value (Rmin/t) which was the result of dividing obtained minimum bending radius (Rmin) by the thickness of the steel sheet (t).

Figure 3:
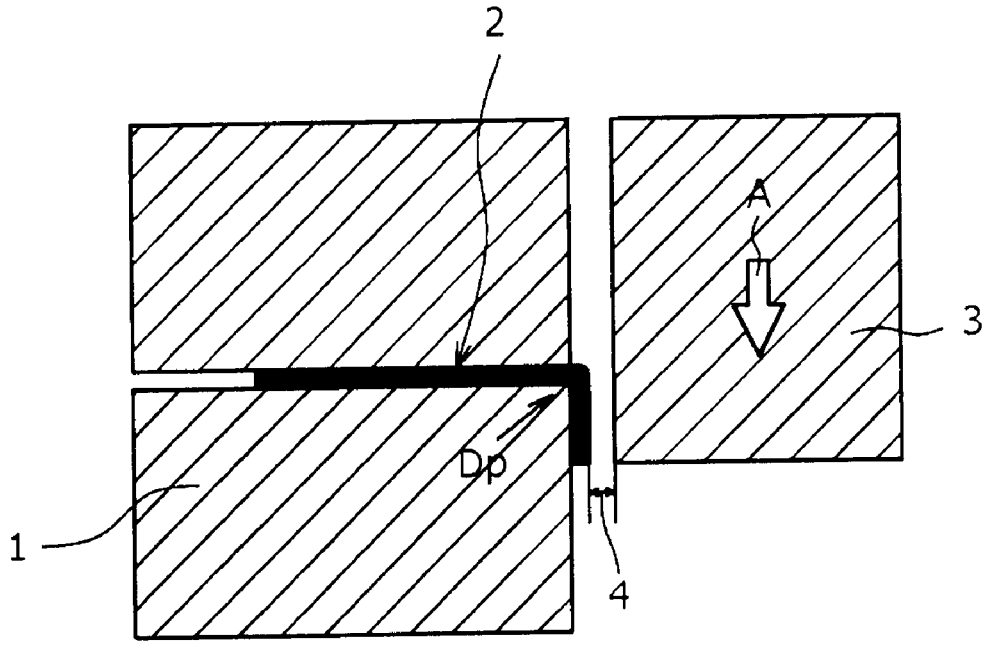
FIG. 3 is a drawing schematically showing a method of a bending workability test.

Here, 90 degree bending work in L direction and C direction was performed using a No. 1 test piece (1.2 mm sheet thickness) stipulated in JIS Z 2204 and a tool shown in FIG. 3 changing the die shoulder radius Dp in units of 0.5 mm. More specifically, as shown in FIG. 3, after the test piece 2 was fixed by a die 1, the test piece 2 was fit to the shoulder of the die 1 by moving a punch 3 downward (the direction of A in FIG. 3). In FIG. 3, a clearance 4 is the distance (gap) between the die 1 and the punch 3 which was made sheet thickness of the test piece +0.1 mm. In the present example, because the test piece with 1.2 mm sheet thickness is used, the clearance 4 becomes 1.3 mm. After 90 degree bending work was performed as described above, the minimum bending radius (the minimum value of the die shoulder radius Dp, mm) at which bending can be performed without causing a crack was obtained. Presence or absence of the crack was examined using a magnifying glass, and was judged with a criterion that a hair crack was not generated.

As described previously, bending workability differs according to the strength and sheet thickness of a steel sheet. Therefore, in the present example, the minimum bending radius Rmin (mm)/sheet thickness t (mm) of the steel sheet (sheet thickness t=1.2 mm in the present example) was calculated for both L direction and C direction, and bending workability was evaluated in accordance with the criterion described below according to the strength level of the steel sheet.

780 MPa level: Rmin/t≦0.3 is deemed passed (780 MPa or above and below 980 MPa)

980 MPa level: Rmin/t≦0.5 is deemed passed (980 MPa or above and below 1,180 MPa)

1,180 MPa level: Rmin/t≦1.0 is deemed passed (1,180 MPa or above)

In the present example, one which passed in both L direction and C direction was evaluated as "excellent in bending workability", and one which failed in either one was evaluated as "inferior in bending workability".

Figure 4:
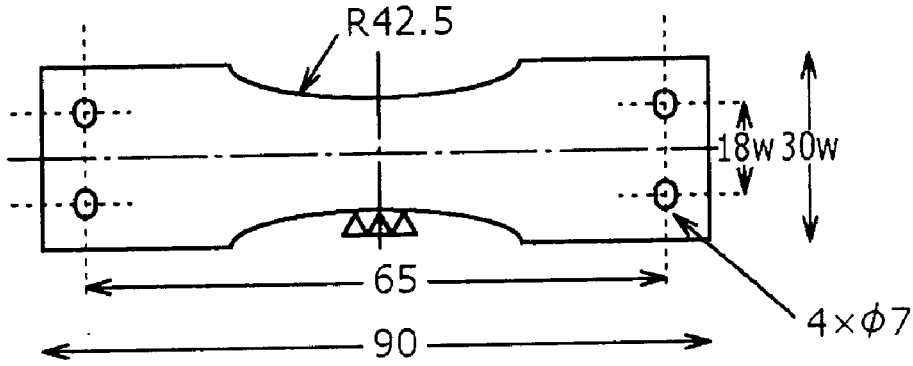
FIG. 4 is a drawing showing a plane bending test piece used in measuring the fatigue strength.

Fatigue strength was calculated by conducting a plane bending test by a method described in JIS Z 2275 using a plane bending test piece shown in FIG. 4. Here, repetition speed was made 1,500 times/minute (frequency of 25 Hz), and the stress ratio (R) was made −1. The ratio of the fatigue strength thus obtained to the tensile strength was obtained as a fatigue limit ratio, and one with over 0.45 fatigue limit ratio was made o (passed) whereas one equal or below 0.45 was made x (failed).

The results of them are exhibited together in Table 2. In Table 2, "M" written in the column "phase formed by low-temperature transformation" means martensite. Also, the column "comprehensive evaluation" was arranged in the column "bending workability", and "o" was put for one which passed in both L direction and C direction, wheareas "x" was put for one failed in at least either one.

TABLE 1

| Steel kind | C | Si | Mn | P | S | sol. Al | N | Others | $Ac_3$ point |
|---|---|---|---|---|---|---|---|---|---|
| A | 0.17 | 1.35 | 2.00 | 0.010 | 0.001 | 0.035 | 0.0041 | | 848 |
| B | 0.13 | 0.80 | 2.30 | 0.005 | 0.002 | 0.030 | 0.0033 | | 819 |
| C | 0.13 | 1.40 | 1.85 | 0.005 | 0.002 | 0.035 | 0.0040 | | 861 |
| D | 0.09 | 1.50 | 2.10 | 0.005 | 0.002 | 0.060 | 0.0050 | | 881 |
| E | 0.09 | 0.65 | 2.50 | 0.005 | 0.002 | 0.035 | 0.0040 | Mo: 0.10 | 824 |
| F | 0.08 | 1.20 | 2.10 | 0.005 | 0.002 | 0.035 | 0.0030 | Mo: 0.25 | 869 |
| G | 0.09 | 1.60 | 2.30 | 0.005 | 0.002 | 0.035 | 0.0035 | Cr: 0.6 | 863 |
| H | 0.07 | 1.20 | 2.00 | 0.005 | 0.002 | 0.035 | 0.0025 | | 867 |
| I | 0.13 | 1.10 | 2.30 | 0.005 | 0.002 | 0.035 | 0.0030 | Ti: 0.02 | 834 |
| J | 0.13 | 1.10 | 2.30 | 0.005 | 0.002 | 0.035 | 0.0030 | Nb: 0.02 | 834 |
| K | 0.17 | 1.40 | 2.00 | 0.010 | 0.001 | 0.035 | 0.0030 | Ca: 0.0015 | 850 |
| L | 0.25 | 1.30 | 2.10 | 0.010 | 0.003 | 0.035 | 0.0030 | | 825 |
| M | 0.22 | 0.20 | 2.80 | 0.010 | 0.003 | 0.035 | 0.0030 | Cr: 0.6 | 755 |
| N | 0.17 | 1.50 | 1.20 | 0.010 | 0.003 | 0.035 | 0.0030 | | 878 |
| O | 0.03 | 0.80 | 1.50 | 0.010 | 0.004 | 0.035 | 0.0030 | Cr: 0.1 | 885 |

TABLE 2

| No. | Steel kind | T1 ° C. | T2 ° C. | T3 ° C. | CR1 ° C./s | CR2 ° C./s | T4 ° C. | Areal proportion of PF (%) Minimum value | Maximum value | Maximum value − minimum value | Phase generated by low-temperature transformation |
|---|---|---|---|---|---|---|---|---|---|---|---|
| 1 | A | 880 | 640 | 540 | 30 | 10 | 350 | 45 | 72 | 27 | M |
| 2 | B | 880 | 640 | 580 | 25 | 10 | 450 | 22 | 53 | 31 | M |
| 3 | C | 900 | 640 | 590 | 30 | 5 | 300 | 36 | 68 | 32 | M |
| 4 | D | 900 | 670 | 580 | 30 | 10 | 400 | 40 | 68 | 28 | M |
| 5 | E | 870 | 670 | 590 | 25 | 10 | 450 | 29 | 47 | 18 | M |
| 6 | F | 880 | 690 | 600 | 25 | 10 | 450 | 39 | 52 | 13 | M |
| 7 | G | 900 | 680 | 580 | 25 | 10 | 450 | 25 | 54 | 29 | M |
| 8 | H | 910 | 630 | 520 | 30 | 10 | 350 | 68 | 70 | 2 | M |
| 9 | I | 880 | 650 | 550 | 25 | 10 | 300 | 14 | 44 | 30 | M |
| 10 | J | 880 | 680 | 600 | 25 | 10 | 430 | 15 | 53 | 38 | M |
| 11 | K | 880 | 680 | 500 | 25 | 10 | 350 | 20 | 39 | 19 | M |
| 12 | L | 880 | 640 | 500 | 25 | 10 | 300 | 5 | 38 | 33 | M |
| 13 | M | 850 | 640 | 550 | 25 | 10 | 350 | 4 | 42 | 38 | M |
| 14 | N | 900 | 640 | 550 | 25 | 10 | 350 | 77 | 90 | 13 | M |
| 15 | O | 900 | 640 | 550 | 25 | 10 | 350 | 86 | 98 | 12 | M |
| 16 | A | 860 | 750 | 650 | 20 | 10 | 450 | 10 | 55 | 45 | M |
| 17 | A | 840 | 700 | 500 | 25 | 10 | 300 | 40 | 83 | 43 | M |
| 18 | G | 900 | 750 | 670 | 7 | 20 | 400 | 15 | 70 | 55 | M |
| 19 | G | 850 | 750 | 650 | 7 | 20 | 400 | 35 | 88 | 53 | M |
| 20 | H | 910 | 650 | 450 | 25 | 10 | 350 | 68 | 90 | 22 | M |

| No. | YP MPa | TS MPa | El % | Bending workability: L direction Minimum bending radius Rmin (mm) | L direction Rmin/t | C direction Minimum bending radius Rmin (mm) | C direction Rmin/t | Comprehensive evaluation | Fatigue limit ratio |
|---|---|---|---|---|---|---|---|---|---|
| 1 | 669 | 1045 | 15 | 0 | 0 | 0.5 | 0.4 | ○ | ○ |
| 2 | 707 | 1010 | 15 | 0 | 0 | 0.5 | 0.4 | ○ | ○ |
| 3 | 639 | 983 | 16 | 0 | 0 | 0.5 | 0.4 | ○ | ○ |
| 4 | 724 | 1020 | 14 | 0 | 0 | 0.5 | 0.4 | ○ | ○ |
| 5 | 745 | 1035 | 15 | 0 | 0 | 0.5 | 0.4 | ○ | ○ |
| 6 | 770 | 1027 | 15 | 0 | 0 | 0 | 0.0 | ○ | ○ |
| 7 | 846 | 1007 | 15 | 0 | 0 | 0.5 | 0.4 | ○ | ○ |
| 8 | 577 | 790 | 20 | 0 | 0 | 0 | 0.0 | ○ | ○ |
| 9 | 1035 | 1190 | 12 | 0 | 0 | 1.0 | 0.8 | ○ | ○ |
| 10 | 886 | 1080 | 13 | 0 | 0 | 0.5 | 0.4 | ○ | ○ |
| 11 | 803 | 1030 | 14 | 0 | 0 | 0 | 0.0 | ○ | ○ |
| 12 | 961 | 1130 | 8 | 1.5 | 1.3 | 3.0 | 2.5 | X | ○ |
| 13 | 796 | 1090 | 13 | 1.5 | 1.3 | 2.5 | 2.1 | X | ○ |
| 14 | 387 | 624 | 25 | 0 | 0.0 | 0 | 0.0 | ○ | X |
| 15 | 334 | 471 | 32 | 0 | 0.0 | 0 | 0.0 | ○ | X |
| 16 | 888 | 1045 | 12 | 0.5 | 0.4 | 2.0 | 1.7 | X | ○ |
| 17 | 760 | 1030 | 15 | 0.5 | 0.4 | 2.0 | 1.7 | X | X |
| 18 | 834 | 1030 | 15 | 0.5 | 0.4 | 2.0 | 1.7 | X | ○ |
| 19 | 693 | 990 | 16 | 1.0 | 0.8 | 2.5 | 2.1 | X | X |
| 20 | 553 | 740 | 24 | 0 | 0.0 | 0 | 0.0 | ○ | X |

From Table 2, following consideration is possible.

Each of Nos. 1-11 is the example of the present invention using the steel kind A-K of Table 1 satisfying the composition of the present invention and manufactured by the method satisfying the requisites of the present invention in which all of the maximum value (Fmax), the minimum value (Fmin) and the difference of the maximum value and the minimum value (variation) of the areal proportion of the polygonal ferrite satisfied the requisites of the present invention, therefore the high strength steel sheet excellent in bending workability in both L direction and C direction and excellent also in fatigue strength were obtained. Further, these steel sheets were excellent in the elongation characteristics as well.

On the other hand, the cases described below which do not satisfy any of the requisites of the present invention have the defects as follows.

No. 12 is the case using the steel kind L of Table 1 with much C quantity, No. 13 is the case using the steel kind M of Table 1 with little Si quantity, formation of the polygonal ferrite was insufficient and the minimum value (Fmin) of the areal proportion of the polygonal ferrite became low in both cases, and bending workability in both L direction and C direction deteriorated. Further, the elongation deteriorated as well.

No. 14 is the case using the steel kind N of Table 1 with little Mn quantity, in which the polygonal ferrite was generated excessively, the maximum value (Fmax) of the areal proportion of the polygonal ferrite increased, and the fatigue strength and tensile strength deteriorated.

No. 15 is the case using the steel kind O of Table 1 with little C quantity, in which the polygonal ferrite was generated excessively, the maximum value (Fmax) of the areal proportion of the polygonal ferrite extraordinarily increased, tensile strength extremely deteriorated, and the fatigue strength deteriorated as well.

All of No. 16-No. 20 are the cases using the steel kind satisfying the componential composition of the present invention.

Out of them, both of No. 16 and No. 17 are the cases using the steel kind A of Table 1. In No. 16, T2 in the annealing process was high, therefore variation of the areal proportion of the polygonal ferrite was large and bending workability in C direction deteriorated. Also, in No. 17, the annealing temperature T1 was lower than $Ac_3$ point (848° C.), therefore the polygonal ferrite was generated excessively, the maximum value (Fmax) of the areal proportion of the polygonal ferrite increased, and the fatigue strength deteriorated as well.

No. 18 and No. 19 are the cases imitating the annealing process described in the Patent Document 2 (two-step cooling of slow cooling→rapid cooling). More specifically, in both of them, the steel kind G of Table 1 was used and cooling was performed with CR1 in the annealing process being made slow (slow cooling) and with CR2 being made quick (rapid cooling), therefore variation of the areal proportion of the polygonal ferrite was enlarged and bending workability in C direction deteriorated. Also, in No. 19, the annealing temperature T1 was 850° C. which was lower than $Ac_3$ point of the steel kind G (863° C., refer to Table 1), therefore the polygonal ferrite was generated excessively, the maximum value (Fmax) of the areal proportion of the polygonal ferrite increased, and the fatigue strength deteriorated as well.

In No. 20, the steel kind H of Table 1 was used and T3 was made as low as 450° C., therefore the polygonal ferrite was generated excessively, the maximum value (Fmax) of the areal proportion of the polygonal ferrite increased, and the fatigue strength deteriorated. Also, the strength deteriorated as well.

The invention claimed is:

1. A high strength steel sheet with 780 MPa or above tensile strength excellent in bending workability and fatigue strength, wherein (1) a composition of the steel sheet comprises:

C: 0.05-0.20% (in mass % with respect to chemical composition, hereinafter the same);

Si: 0.6-2.0%;

Mn: 1.6-3.0%;

P: 0.05% or below;

S: 0.01% or below;

Al: 0.1% or below;

N: 0.01% or below; and iron and inevitable impurities, and (2) a microstructure of the steel sheet comprises a polygonal ferrite structure and a structure formed by low-temperature transformation, in which when a plane located at a depth of 0.1 mm from a surface of the steel sheet is in the observation under a scanning electron microscope (SEM) with respect to twenty sights in total in different positions in the sheet-width direction, the maximum value of areal proportion of the polygonal ferrite (Fmax) and the minimum value of areal proportion of the polygonal ferrite (Fmin) in a 50 μm×50 μm area in each sight satisfy all of Fmax≦80%, Fmin≧10%, and Fmax−Fmin≦40%.

2. The high strength steel sheet according to claim 1, further comprising at least one kind selected from the group consisting of:

Nb: 0.1% or below;

Ti: 0.2% or below;

Cr: 1.0% or below; and

Mo: 0.5% or below.

3. The high strength steel sheet according to claim 1, further comprising at least one of:

Ca: 0.003% or below; and

REM: 0.003% or below.

4. The high strength steel sheet according to claim 1, wherein the steel sheet has a $R_{min}/t \leqq 0.3$ when the strength of the steel sheet is at 780 MPa or above and below 980 MPa wherein $R_{min}$ is a minimum bending radius and t is a thickness of the steel sheet.

5. The high strength steel sheet according to claim 1, wherein steel sheet has a fatigue limit ratio at over 0.45 wherein the fatigue limit ratio is a ratio of a fatigue strength and a tensile strength of the steel sheet.

6. The high strength steel sheet according to claim 1, further comprising Mn in a range of from 1.8 to 2.8 mass %.

7. The high strength steel sheet according to claim 1, further comprising C in a range of from 0.07 to 0.17 mass %.

8. The high strength steel sheet according to claim 1, further comprising Si in a range of from 0.8 to 1.8 mass %.

9. The high strength steel sheet according to claim 1, wherein the steel sheet has a $R_{min}/t \leqq 0.5$ when the strength of the steel sheet is at 980 MPa or above and below 1,180 MPa wherein $R_{min}$ is a minimum bending radius and t is a thickness of the steel sheet.

10. The high strength steel sheet according to claim 1, wherein the steel sheet has a $R_{min}/t \leqq 1.0$ when the strength of the steel sheet is at 1,180 MPa or above wherein $R_{min}$ is a minimum bending radius and t is a thickness of the steel sheet.

11. The high strength steel sheet according to claim 1, wherein the steel sheet is obtained by a process comprising rapid and slow cooling rates wherein the rapid cooling rate is 15° C./s or more and the slow cooling rate is 10° C./s or below.

12. The high strength steel sheet according to claim 1, wherein Fmin >20%.

* * * * *